US007509766B2

(12) United States Patent
Vasquez

(10) Patent No.: US 7,509,766 B2
(45) Date of Patent: Mar. 31, 2009

(54) WEAPON USE TRACKING AND SIGNALING SYSTEM

(76) Inventor: Eduardo Carlos Vasquez, 107 Mendoza Ave., Coral Gables, FL (US) 33134

( * ) Notice: Subject to any disclaimer, the term of this patent is extended or adjusted under 35 U.S.C. 154(b) by 623 days.

(21) Appl. No.: 10/773,862

(22) Filed: Feb. 6, 2004

(65) Prior Publication Data

US 2004/0200109 A1 Oct. 14, 2004

Related U.S. Application Data

(60) Provisional application No. 60/445,481, filed on Feb. 7, 2003.

(51) Int. Cl.
*F41A 9/53* (2006.01)

(52) U.S. Cl. ..... 42/1.01; 42/1.02; 42/1.05

(58) Field of Classification Search ..... 42/1.01, 42/1.02, 1.05, 14, 15, 16
See application file for complete search history.

(56) References Cited

U.S. PATENT DOCUMENTS 5,052,138 A * 10/1991 Crain ..... 42/1.02
5,303,495 A * 4/1994 Harthcock ..... 42/84
6,643,968 B2 * 11/2003 Glock ..... 42/1.02
6,775,940 B2 * 8/2004 Dworzan et al. ..... 42/1.01

* cited by examiner

*Primary Examiner*—John W Eldred

(57) ABSTRACT

This invention refers to a compact monitoring system for firearms, including a detecting and tracking structure and a method for confirming ammunition has been discharged from said weapon, more specifically, to a weapon usage detecting and tracking device and a method that utilizes battery operated microcontroller circuitry, and could be used in combination either with a load depletion process warning system which in turn comprises a method for signalizing the user of the depletion process using luminous indicators, and a time and date event recorder or in combination with both, sharing substantially the same structure. Provisions are made in the time recording structure to securely retrieve use information at a further date in a way that may include secure handshaking and a serial number.

38 Claims, 10 Drawing Sheets

WEAPON USE TRACKING AND SIGNALING SYSTEM

This application claims priority of provisional app No. 60/445,481 filed Feb. 7, 2003

BACKGROUND OF THE INVENTION

A concern, which many law enforcement, armed forces, or security personnel may encounter during a firearm confrontation, is the inability to determine with certainty when the load of ammunition in a firearm is running low in order to reload timely.

At the lack of an adequate weapon discharge reporting system that would provide crucial life preserving information to the user, currently adopted procedures in place, if any, are purely intuitive, and are acquired by training relying mostly on the user's state of mind.

At any point of a never desired but possible confrontational firing event, the inevitable strain imposed by such circumstances, ends up making it extremely difficult for the user to keep a mental record of his ammunition consumption.

Opting to replace a spent magazine is therefore turned into a hit and miss activity; a still partially loaded clip is sometimes wastefully dropped and replaced for a new one in the attempt of not being caught on empty.

It is widely known and accepted that human beings under stressful situations react more consistently when conditioned to respond to a sensorial reference than to an adopted routine that implies analytical thought and comparison into a memorized data.

Habitual conditioned reactions are for every person that drives a motor vehicle in a city provided with traffic signals, to stop on a red light, and to go on a green one. The same applies to a flashing light form a barricade that calls for caution and a reduced speed, as a yellow traffic light would prompt said driver to prepare to stop before a change to red or prepare to advance when changing to green in a traffic signal.

Other prior art U.S. Pat. Nos. 5,052,138, 5,142,805, 5,592,769 and 6,094,850 disclose structures that include means to track the ammunition depletion process by closed loop monitoring the weapon's magazine or the magazine well utilizing a plurality of switches or contacts remotely wired from the tracking means hence requiring a much more complex fixed adaptation to the frame of the weapon. In the case of a residual count numerical display, the depletion process as reported could be very hard to view under certain circumstances and calls for some degree of analytical perception that could simply not be available under stress.

U.S. Pat. No. 6,094,850 utilizes an illuminated report at the very last portion of the load were it doesn't aid the user as a trailing signalization in the process of depletion of the ammunition load and requires a complex mechanical assembly to detect the process of ammunition expenditure.

U.S. Pat. No. 5,566,486 discloses an inertial detector also with a numerical display.

U.S. Pat. No. 5,406,730 discloses a dual detecting means including sound and also inertial switch event reports to the tracking means, and the display is also numerical and mounted on the grip and U.S. Pat. No. 6,643,968 discloses a pistol also with a dual event detecting means built specifically into the weapon frame, based on said frame undergoing distortion, it is aimed only for usage record keeping, and does not include a per load tracking capability.

All of the abovementioned are in one or another way different and less practical to be retrofitted into an existing weapon, as it will be disclosed in this application.

This application makes reference to my prior patent U.S. Pat. No. 5,735,070 titled Illuminated Gun Sight and Low Ammunition Warning System For Firearms filed on 1996.

In this specification, a battery operated electronic firing event detecting, tracking and signaling system with the purpose of signaling a user about a low ammunition condition being reached was disclosed.

Among others, the possibility that this signaling means could be a visible indicator, and the possibility of utilizing multiple signal means that could be triggered at different count events was also disclosed in claims 38, 47, 51, and 52.

This application is in part an advanced detecting and tracking assembly and method supporting the Low Ammunition Warning System portion disclosed on said application and additionally an event time and date recording assembly.

A device capable of reliably reporting the ammunition depletion process on a weapon is of evident tactical value for improving the safety of either members of the military forces or members or the police departments. In the event a confrontation may arise, they will have a simple referential indicator to help them take safe action for reloading or for better management of their critical ammunition resources.

BRIEF SUMMARY OF THE INVENTION

This invention refers to a monitoring system for firearms, including an assembly and a method for detecting ammunition has been discharged from a load carried by said weapon that utilizes a battery operated microprocessor or microcontroller based programmable assembly including a per load depletion monitoring system with provisions to enable signals to the user regarding the depletion process of said load of ammunition, or provisions for time and date event recording or a combination of both provisions sharing substantially the same monitoring structure.

When operating an automatic or semiautomatic weapon, several events can take place.

Asides from placing a loaded clip and removing a spent one, and manually chambering a new round, etc., in the operation of a weapon, there are cyclic events inherent to the actual discharging and automatic reloading of a round that are typical to each type of weapon.

These cyclic events are dynamic in nature and involve weapon mechanical components that are abruptly urged to displace from an initial rest state by a round discharge event, and following a cycle of operation, arrive slamming into an abrupt stop in a limit home position as a new round is chambered and as the weapon becomes enabled to start another cycle. This activity is initially driven by certain amount of energy derived of the explosive content of the actual round being discharged, being the return portion of said cycle, aided by the automatic round reloading driving provisions of said weapon.

Upon operating said weapon, the combined effect of moving component collisions with the abrupt acceleration and deceleration which these undergo, generate dynamically sizable and well defined reports that are in substantial synchronicity with the beginning and the end of said weapon mechanical cycle of operation.

The components that are actuated, vary somewhat according to weapon designs and substantially according to weapon type, nonetheless, a cycle of dynamics of discharge and reload is always present, with different duration, different amounts of energy, different mechanical structures being involved, but always present and their duration is linked to the weapon net rate of fire. By properly coupling an adequate form of detecting means adapted to generate electrical impulses from dynamic stresses induced unto said detecting means by said weapon's dynamic activity, sets of pulses representative of these peak dynamic events taking place while discharging or discharging and reloading, or reloading combined with automatically discharging of a round could be tracked. Furthermore, by understanding the nature and the physical properties of the typical cycle of the dynamic mechanical activity of the weapon in which said detecting means is adapted, higher level electrical pulse sets detected in this manner, can be identified as to correspond to abrupt acceleration or deceleration and structural shock and vibration events taking place in substantial synchronicity with the actual discharge of a projectile or when the reload provisions of said weapon return to a striking stop whilst chambering a new round.

Consequently, these detected higher electrical pulse sets, could be logically interpreted as being representative of these particular events subsequently correlated, and said information used for further tracking purposes.

This method utilizes an electrical pulse generating detecting structure in combination with a tracking means. Said tracking means comprising a programmable controller assembly including timing provisions and capable of storing and running at least one program, which in turn includes, asides from its supporting power resource and circuitry, the corresponding electrical and logic implementation required to identify, interpret and determine the nature of an event or events detected. Presets embedded in the tracking software aiding in this determination may include as needed, data of parameters representing the weapon net rate of fire, the weapon full cycle time, partial cycles times, signal thresholds, and others, as well as, if required, the possibility of selecting different presets of the same for providing some degree of adjustment to accommodate possible variations of these parameters in real life application. Further adaptability is possible for certain cases also, by acquiring full cycle timing presets from the same weapon while discharging rounds on automatic mode, by a simple software implementation adaptable to the same assembly. By enabling recording of the periodicity of the pulse pattern sequence induced in the detector by discharging a test sequence of rounds, a custom cycle timing preset is thusly easily acquired and then loaded for use on the system. This stems from a well used practice on systems like the present one, that can utilize their own sensor feedback for establishing their functional limits from a test run. A basic tracking configuration utilizes per cycle tracking provisions that correlates the time of occurrence of detected higher electrical impulse sets, with peak dynamic events typically contained within a cycle of operation of said weapon. Mechanical provisions on a weapon operate following a pattern and a cycle having intensities and substantially consistent time duration between events that is characteristic to said weapon. Said tracked peak dynamic events follow a logic sequence and time frame of occurrence linked to the weapon cycle of operation. Tracking events within a cycle is then possible by tracking the presence or absence of detected higher impulse sets within the tracked cycle time, and logically interpreting the results by correlating the results to the presets. Further translating this information into a global track that tracks a count discharge events is then easily implemented for tracking general weapon activity. Tracking of continuous cycle repetitions as those detected when discharging a weapon in full automatic mode can also be easily implemented since the reload and discharge events are closely integrated into one dynamic event as they take place substantially simultaneously. Consequently, tracking the periodicity of the detected events is then used to ascertain that said weapon is being discharged automatically as the detected electrical impulse sequence is found to closely correlate to the presets representing the weapon's net rate of fire. When this is established, then the tracking system will track count of said events as one discharge and reload per event.

A method utilizing an adequately certain detecting structure and a tracking structure in combination, said tracking means being a programmable controller including built in timing provision, capable of storing and running a program, which in turn includes, asides from its supporting power resource and circuitry, the corresponding logic useful for the determination of the nature of an event detected.

After properly determining the nature of the detected information, preprogrammed activity such as reporting a signal or data recording, could then be executed with a substantial degree of certainty.

The possibility that by the use of an adequately adapted detecting means in combination with a tracking structure having provisions to identify if a round has been discharged and reloaded automatically, if the round just discharged was the last one of that particular load or if a round that has just been chambered, is still contained within said particular load count, provides the great practical advantage for correctly tracking ammunition expenditure on a per load basis, since the capability of recognizing the discharge of a last round of a load, a count reset is then correctly performed, automatically enabling tracking of a new load, from the default load count preset. As a result, since a load has a quantitative specification, and there is a beginning and an end to its discharge, linking reports regarding its changing status, becomes an easy implementation. Needless to say, support for recording of round discharge history using basically the same functional structure is easily accomplished.

The present invention is directed to an assembly for use on a firearm, and more particularly, to a weapon usage detecting and tracking device which may include provisions for activating signals aimed to provide to the user with perceivable reports regarding a weapon's ammunition load status.

Said usage detecting and tracking structures combine also with a real time clock and memory provision to record firing events for future download.

In consideration of this not being limiting, the required preferred embodiment of the present invention is an example form depicting also how an assembly like this lends itself to be so compactly built that fits into such a small component of said weapon. This is an innovation that brings upon a solution that is highly adaptable and versatile, since weapon structural shock and vibration as well as abrupt acceleration changes are widely tangible throughout most of the weapon assembly as it is operated, and a detecting and tracking structure could be successfully adapted in any of multiple locations of said weapon. In addition, the minimal footprint required for this solution, lends itself for a variety of embodiments that could suit successfully different weapon topologies and components in which this could be adapted. In this case it is shown as it is built into a casing that is nested on the firing pin cover plate well on a striker pin type of automatic weapon, while replacing said firing pin cover in functionality also. Visible indicators exemplified are disposed in the proximal end of said casing and visual changes taking place on said indicators responsive to the tracking means, are conveniently located for they be visible by the user.

The same approach of practical adaptation of this invention into components also serving functional purposes of said weapon, result on several embodiments that could adopt a variety of forms, such that while being embedded in an structure that is used as part of a weapon, they also allow for adequate dynamic event tracking and the installation of adequately visible indicators. Just to list some of the most relevant, a gunsight that while functioning as such, also reports ammunition status information. For an example of this, we will refer to the inventor's prior U.S. Pat. No. 5,735,070 titled Illuminated Gun Sight and Low Ammunition Warning System in which the single color light sources are replaced with now widely available and highly compact surface mount multicolor leds. Utilizing the same sighting visual indicia structure, reports to the user regarding ammunition status information are enabled by simply applying color or visual pattern changes to said visual indicia. In this case, the location is also adequate for installing the detecting means and the compactness of this solution lends itself be easily built into such assembly while visual indicators are also conveniently located for the user. Another form could also be a scope sight adapted with an LCD reticle displaying a bar stack that varies visually, or the same containing color changing internal luminous features, etc. Several other forms also fall within the category wherein a component that is integral or retrofittable to a weapon can also house said system due to the compactness of the assembly and the fact that shock, vibration, and acceleration changes could be detected throughout a weapon structure and some form of visual report could also be implemented.

Comprised in the assembly, are a power source, a simple and condensed programmable controller circuit, and properly adapted detecting means with optional signal conditioning supporting circuitry. Externally accessible is at least one programming and reset control means, adapted to alter presets in said programmable controller, or to perform a reset operation. Alternatively, access provisions to removably attach the required form of control means could obviously be implemented for further control enhancements or to achieve a more compact assembly.

The fundamental single detecting device preferred version is based on an adequately adapted piezoelectric detecting device generating an electrical pulse pattern in correlation to the dynamically induced stresses occurring when said weapon is actuated.

An alternate form combines with a second slide home default position detecting component which in turn could be a switching provision that reports a slide breaking away from said home default position by either deriving electrical flow or interrupting a circuit. It can perform also as a programming level selecting device in the case of a highly compact installation. A piezoelectric component that generates an electrical pulse when departing or returning to said home default position optionally can be used to act as a double certain detector for a last shot fired in combination an assembly that utilizes an inclination or tilt event detector.

According to the design criteria of the particular embodiment being implemented, for activating the device, a master power switch, automatic power up provisions, or a combination of both could be obviously adapted. Power conservation means possible, include commonly used practices of activating and enabling tracking activity from a lower power sleep mode wait state upon the occurrence of an electrically detectable event, programmed furthermore to return to said sleep mode wait state upon completing an activity cycle. Depending on the number of leads available of the microcontroller utilized, multiple signal reporting means and signal patterns with duty cycle controls for said signals or power conservation energizing patterns could be easily implemented, and related embedded presets can be selectively recalled by a control means, allowing certain degree of signal customization. Real time firing events history recording options by means of minimal software and hardware adaptation is a useful functional expansion.

In this case, without this form being limiting of others possible, a per load depletion signaling system including a plurality of led devices is shown. In the case of an event recorder version, non-volatile memory and real time clock provision adapted to the tracking structure, provide time reference so that the controller can execute operations to store time and date information correlated to each tracked event in chronological succession into said memory component, thusly creating a data string representing the discharge history of said weapon that is retrievable at a further date.

The event detecting viewed in more detail, is resolved by an adequately coupled piezoelectric detecting means generating electrical pulse sets whilst undergoing stresses induced by the dynamic activity of the weapon being operated. Said electrical pulse sets contain electrical impulses of varied magnitude comprising within, higher level portions of impulses that are correlated in time with moments comprised within the operating cycle that are characterized by their higher dynamic intensity.

For a particular type of weapon, each type of activity has certain dynamic characteristics, and the succession of dynamic events that take place follow a certain logical order and moment in time they occur within said weapon cycle. An operating cycle is typical to each type of weapon, and weapon activity of a particular type of weapon can be represented by an electrical impulse sequence equivalence as this is reported within said weapon operating cycle time frame by the detector to the tracking means. Hence, typical higher dynamic events timing parameters characterizing a particular type of weapon operating cycle, that are contained as presets and logic operators within the tracking means are used to ascertain if said weapon has been discharged, discharged and reloaded or manually operated, The very first portion of the event corresponding to discharging a round, induces on a detector intense stresses as a consequence of the abrupt rearward acceleration occurring in reaction to the projectile being propelled forward and then exiting the barrel. Structural shock and vibration that are also inherently present at this same time as a consequence of the actual explosion of the charge acting against the moment of inertia of the structure and by inducing collisions of weapon component stacks, and thusly cooperate concurrently on inducing further more stresses on said detector. Depending on the type of detector and its adaptation, one or another part of the physical phenomena will cooperate in greater measure in generating the higher pulse set reporting this event. Needless to say that detector placement and installation, have to include considerations to limit potentially destructive excessive shock and high frequency vibration generated when discharging a round.

An adequately adapted piezoelectric detector, properly coupled to the weapon will in this case report a proportionally intense electrical pulse set in correspondence to the induced stresses. Adequately adapting a piezoelectric detector for achieving the best trackable reports may include aside from detector type selection, proper encasement, mechanical and electrical filtering and signal conditioning, all working cooperatively in order to keep unwanted resonance reasonably low. In this way the decay of the detector report is kept substantially prompt and closely trailing to the most relevant dynamic take place within the weapon operating cycle.

After the first shock type portion of the event, the recoil motion then follows, which is a constantly decelerating process in nature, and as in this example using a recoil operated type weapon, it is exclusively due to the recoil spring that compresses absorbing a good portion of the enemy carried by the slide, until said slide reaches the bottom of the rear bound stroke.

Variables like return spring tension, slide friction, magazine spring tension, powder charge and bullet weight among others, are variables that affect a weapon cycle duration somewhat, but there is still a time frame within an acceptable tolerance, repetitive enough as to be utilized as a predictable reference for implementing a reliable tracking means with programmed logic operators adapted for identifying events inherent to the operation of said weapon with sufficient certainty, by monitoring and tracking electrical pulse sequences generated by an adequately adapted piezoelectric detector setup.

During this rearward displacement, remnant vibration from the discharge event tapers off and low level friction activity is present, which still clocked, but deemed irrelevant, and in practice, like would be done for optimizing an electrical impulse tracking operation, filtered or squelched, since the system is then seeking for the presence or absence of higher magnitude events that would occur only in expected moments in time within a particular weapon typical mechanical operating cycles.

When the rearward cycle portion reaches its end, another pulse segment occurs which is representative of this bottoming event, in which for an instant in time, the slide is stopped completely and then reverses its travel direction. This signal portion is typically of much lower magnitude than the first discharge portion in view of the weapon recoil absorption provisions having dissipated most of the energy from the discharge, and its report if detected while being of much lesser magnitude than those generated by the discharge or reload events, varies somewhat depending to the type of weapon and detector installation. In the case of a recoil type handgun, a stiff frame type weapon reports a higher magnitude and tighter report pattern opposite to a composite frame weapon that presents certain resiliency further cushioning the end of the rearward stroke. On some types of weapons of different design, more specifically those of the type that have an internally reciprocating bolt, a detector and the tracking system can be adapted to read this portion of the discharge event in the case in which this is more fitting for accurate tracking.

Providing there is another round available from the load, a reverse direction displacement automatically then takes place, and the slide portion of said weapon starts a return travel aided by the force of the slide spring, inducing as it travels also another set of pulses basically due to vibration induced by friction and other activity, like dragging a new round out of the clip. Even though this signal trail falls within the tracked cycle time which is all along clocked, these sets of pulses are disregarded or filtered off or also squelched as it is typically done to remove background noise in parallel applications. At the end of this displacement, the slide reaches the home position colliding at substantial speed with the supporting structure front limit as it is also urged to decelerate abruptly while chambering a new round, consequently inducing the detector to report another high pulse portion set as it finalizes the cycle arriving to a new fire ready state.

This structural collision and abruptly stopped motion combination induces substantial stress in the detecting means which in turn generates proportional electrical pulses of equivalent nature. This pulse portion is typically, as determined by test and experimentation, only second in intensity to the one induced by the projectile being propelled outwardly and it takes place within an expected time frame, said time frame substantially corresponds to the end portion of what a typical cycle duration that a discharge and reload event of a particular weapon.

The discharge of a round and the reload activity of a weapon, generate electrical pulses that are distinct as they are higher in magnitude of those generated by other portions of the weapon cycle. They are identifiable electrically by their magnitude, but also they occur in a timing linked to the weapon cycle since they take place at known moments within the weapon automatic cycle. The first one, the one generated at the actual discharge of the projectile, is substantially synchronized with the beginning of the weapon said automatic cycle, and the second one is also substantially synchronized with the final part of said cycle which is rechambering of a new round. Detecting said first event triggers the cycle tracking process into activity which will go on for a period of time, seeking for a second high magnitude report that is known to take place within the time the weapon mechanical provisions will take to complete the cycle as a new round is chambered. Subsequently, if said second electrical report takes place as expected, the tracking system acknowledges the tracked cycle as a complete one comprising a discharge and a reload, and if this second high magnitude signal does not take place within the time frame of the tracked cycle, the system acknowledges said tracked cycle as an incomplete one that comprises a discharge but did not included a reload. By utilizing this tracking logic foundation, this system is able to differentiate between a round discharged being still part of a load or it being the last, since in the latter case it will actually track a discharge not followed by a reload. By default, clip count is a known parameter. The weapon, as it uses up a load, will generate a succession of complete cycles until the last round is discharged. Tracking against the load count allows to generate signals correlated to changing load resources, and the last round incomplete cycle report, asides it being tracked as a discharged round, is used for resetting the load tracking to the default count again. Alternatively, if a weapon is being discharged on full automatic mode, tracking is made possible by tracking the periodicity of the reports as taking place in a repetition equivalent to the weapon known automatic rate of fire.

Also, due to the fact that it can track ammunition expenditure on a per load basis, the logical operators in place will identify the detectable dynamics of the loading of a first round of a new load as what it is, and not count it as a round discharged since it is expected after an acknowledged last shot fired of a load since the electrical pulse pattern that represents it, is only a portion of a discharge and reload full cycle.

Likewise, if an accidental dropping of the weapon on a hard surface occurs, this event has to induce stresses of an abruptness, magnitude and orientation enough in a properly adapted detector, otherwise it will not activate the system due to its sensitivity threshold. In the event like this was to occur while the weapon had a full clip as tracked by the load tracking logic, it will keep the count as default since this will appear to be the last shot of the clip or a manual release reload from the hold open position. Error control logic is built into the system such that if an event is detected of being typical of an isolated discharged round with no automatic reload, provisions are made to record the event in the firing log, but tagged as anomalous to the per load tracking, which may in turn be representative of either potential weapon malfunction or misuse, which could be true as sometimes weapons discharge and jam on the reload, or on the other hand from any malicious attempt to defeat the record by loading a single round after a full clip is spent. If a lower number of rounds than a preset load are used in a load, the last event will reset to default count for next clip simply by identifying a discharge with no following reload at any one point of the count this happened. If the weapon is dropped and discharges, the time window criteria will then track a shot fired. Any modern microcontroller properly set up can perform at such clock rate, that is capable of tracking, going to sleep and track again including making reports and enabling signals at a speed such that these events can be tracked and properly identified with ease. A more advanced adaptation including electronic components with multiple built in signal profiling capabilities as multiple programmable voltage comparators in combination with properly tuned detecting means, allow for more specific characterization of impulses in which the footprint of a discharge could be independently identified by its fast rise and decay and its short duration.

The typical mechanical cycle timing regarding discharging a weapon is based on said weapon's rate of discharge if adapted to discharge in automatic mode. As an example if this rate would be 1200 rounds per minute, then a complete automatic cycle of discharge and reload independent of the human factor will take in said weapon approximately $1/20^{th}$ of a second or approximately 50 milliseconds. The tracking system then for said type of weapon is adapted to track events that happen within this time frame on a per cycle basis, in which it would then be possible to ascertain that a round discharged was the last one of a load based on the fact that the last pulse portion typically generated at the completion of the reload portion of a complete cycle of discharge and reload of said weapon, didn't take place within the expected logical window of time that opened somewhat before and closed somewhat after said 50 milliseconds mechanical cycle duration time, this meaning that said cycle was interrupted. To match weapon type and design, other type of detecting and tracking patterns can be implemented, by properly adapting the detecting and tracking means to the dynamic event profile of the weapon.

A corrective reset to default control switch conveniently comes into play when the weapon has being utilized and handled in a different ways than intended, introducing error to the tracking means. Even though a manual reload cycle sets the count to default again and just by doing so, the user can reset the system to initial load count again, a switch can be used for the same purpose. These type of errors are related only to the per load count, but will not affect a net total rounds count tracked in the firing history, since these are based on truly compliant dynamic footprint with a discharge being detected and built in logic event discrimination.

Additional control switches can provide functionality and customization options to the user, and can be adapted as the particular design and application requires.

In variations of the system, a switching device could be used in combination for establishing that the slide has abandoned the home position or has returned. In a similar fashion as pictured on the invention's prior U.S. Pat. No. 5,735,070 titled Illuminated Gun Sight and Low Ammunition Warning System For Firearms, in which a contact is established or broken upon the slide of the weapon arrives or departs from the home position, in this case, said switching device could be of the normally closed or open type and is mounted on the assembly adequately disposed as to be urged into "off" or "on" mode whilst the slide is at the home position and said switching device detecting member is bearing in interference against a mating portion of the weapons frame. An adaptation of a film piezoelectric component that will produce a pulse on arriving to the home position could also be utilized to indicate the moment of return of the slide to the closed position.

Another detecting combination would be using a normally open type switch in which upon said weapon is discharged, the slide displaces rearwards and away from said frame causing the switching device to close the circuit deriving as a consequence a sufficient amount of electricity from its power source to the tracking means as to activate it. The tracking means following its embedded instruction set utilizes its built in time tracking capabilities to identify this event.

If the circuit is broken or remains conductive depending of the switch type set up thereafter in a time typical of the duration of a full discharge and re-chamber event, the tracking means will acknowledge such event has taken place and that there is another round in place in the chamber of said weapon.

If the switch remains conductive or if the circuit remains broken for more that the time it typically takes to complete a full discharge cycle including chambering a new round of ammunition, the tracking means identifies that said discharged round was the last round of the load since semiautomatic weapons will remain by design with the slide open in such a case not allowing said switch to break or close the circuit.

Monitoring in time the state of the switching component, still has further uses.

In this version of the preferred embodiment, if said switching component continues to remain enabled for even a longer period of time, it will invoke a second programming level accessible by the programming and reset switch of the assembly different of a first level that the user could access when the slide is collapsed and the switching detector is off.

Obviously, a user attempting to reach this second programming level, only needs to rack the weapon slide open and wait for the corresponding feedback from the indicators of the programming window being open in order to perform the desired task. Another form of this invention utilizes a supplemental switch for the same purpose instead of the switching detector.

Still further usefulness stem from the monitoring of the state of this switch by the tracking means keeping track that this detector last reported an event recognized as an empty weapon condition. Upon this happening, the count would automatically will reset to the default load count.

A possible irregular user generated circumstance, like it would be the dropping of a not fully spent clip subsequently replaced by a fully loaded one, will be corrected on a per clip basis since a per clip level of resetting will repeat itself automatically at the last round from the current load is spent, limiting cumulative error. In this case in the process of discharging the signal stack will be offset by diminishing the amount of the last warning stack on a count equal to the disposed unspent rounds, but only for one load.

This system is intended to provide means to correct conditions that result from the current lack of feedback of the depletion process of a weapon load resources, basically, the understandable practice of releasing a clip still containing some rounds in precaution of not being left with available firing power.

Abnormal use may always happen, but that is a problem of the user not being trained to be reactive to a signal system in place and that can't be predicted or resolved by any signaling or warning system. It's the main reason why traffic accidents mostly happen, but these accidents are still much less in number than if there were no traffic lights.

A basic example of a luminous warning system, though not limited to this form only, is implemented by utilizing a plurality of colored or multicolored indicators that become selectively illuminated in a relation with the load being discharged.

While starting in one particular color, as the depletion progresses, at set points, the signal changes to another color raising the alert level and will continue in this manner, increasing the warning report to the user until the last level is reached.

For descriptive purposes, we will correlate three color changes reporting increasing levels of warning as signal stacks making a parallel to the stacks of rounds they represent.

This system provides to the user means for being in capacity of customizing his signaling stacks to his personal preference.

Said signaling stacks are differentiated by different color indicators and report basically three levels of alert.

The alert structure is fully customizable as abovementioned, but for this disclosure, we will visualize how a basic preset could be used.

In the preferred embodiment of this invention, the total available rounds per load are divided into three stacks; each one corresponds to an alert level. A first amount, being at a level of first alert, a green light is enabled whilst discharging this stack. Once this stack is spent, as the second alert level, a blue indicator is enabled in relation to the discharge of this stack. In this case a blue indicator as opposed to a yellow one is indicated due to the fact that a yellow like color easily blends with a muzzle blast in twilight or dark. Following will be the last stack that will then be represented by a red colored light, which is the last and the most immediate action prompting signal.

As an example for designing a signal structure, a user having a 17 round load capacity weapon plus a chambered round that wants to implement a linearly incremental urgency warning set of signals corresponding to a progression of stacks containing counts each proportional to 3, 2, and 1 could divide his load as follows:

As the total count of the load is 17+1, totaling 18, and our unit stack is one sixth of this total, deriving from the number series representing the urgency pattern of the selected signal progression as seen in 3+2+1=6. Then the stacks would be: 9 rounds at first warning level, 6 rounds at a second and increased warning level and 3 rounds at a third and highest warning level.

It is possible to implement other patterns by altering the counts per stack. Some users may prefer to have a longer first level and equally lasting second and third alerts, but whichever the case of personal preference is, a last stack could be referenced and linked to the sound of the discharge of three rounds in this case, and engraved into our reaction in the same way we perceive our speed and automatically adjust to brake just in time to not to transgress an intersection.

New developments in other type of sensors provide the opportunity of utilizing other properties of the events happening upon the discharge of a round.

In a handgun, a substantial portion of the firing energy is translated into angular motion.

At the moment of discharge, as a result of the recoil generated, the fired weapon abruptly tilts backwards, synchronized with the rearwards displacement of the slide portion of said weapon.

Upon reaching the rear limit of the stroke, the motion is inverted and said slide portion returns to its home position whilst drawing a new round into the chamber, displacing its mass forwardly finally slamming against its limit forward position. In this process the angular displacement is reversed and an amount of forward tilt beyond the original aiming position takes place.

By detecting this abrupt angular motion with a properly disposed rotational or inclination sensor, a firing event of a weapon can be also identified.

Expanding further into other option of the present embodiment, the detecting and the tracking means being adapted to report and positively identify a discharge event has certainly happened, serve also to prompt to record into memory provision these events in combination to a referential timetable provided by an appended real time clock and said memory provision. In this embodiment, the clock device shown is of a type of package, which includes an extremely small, built in crystal providing the functionality and the shock resistance in an extremely small footprint.

For fixed on board memory provisions, communication means are provided on the assembly as to allow access with a properly adapted external means to the data stored on said memory provision. The memory provision is adapted to record events in a successive manner such that when its storage capacity is reached, it will handle the next data input by overflowing and eliminating the oldest events previously stored. The memory storage access means of choice in this embodiment, though not limited to this particular topology, is of the $I^2C$ serial type device. This type of interface allows operation with a minimal amount of connectivity and its streamlined protocol is sufficiently fast for this application. Removable memory media provisions would be an obvious adaptation that could become evident to those versed on the circuit design trade of this approach is deemed more convenient. In such case, the prescribed memory access and subsequently related provisions will not be required to be built in as disclosed, but alternatively the same universal concept or similar could apply to an external properly adapted reading device.

Management of the recording operation as well as a secure handshake routine for enabling weapon usage data download to said external device is also implemented to be performed by said tracking means upon being enabled and as queried by an external interface adapted for the purpose. Due to the fact that installations like this one, where the space is at its premium, it only makes common sense to utilize a means of accessing the memory chip in a way in which the interconnecting means has also minimum space requirements. A currently available technology for chip-to-chip communications is the $I^2C$ serial bus protocol that requires only three conductors one of which is ground. The others are the talking wires. Compliant to the nature of this kind of serial communications, on the preferred embodiment, an interface connected to the provided pads on the circuit board of the assembly will then contains a device acting as the master chip, and the memory chip will then act as the slave chip. With this into consideration, and furthermore considering that the data to be downloaded has to be an exact copy of the contents of said memory chip, and considering even furthermore that said memory chip contents should not be altered, the interface is built with no user capacity to act upon the data in view of the abovementioned considerations. This is done by embedding an adequately keyed routine into the interface controller chip. Following the data path, there is a computer provision with a screen including also secure software means that automatically encrypts upon downloading, the downloaded information into a integral file that can be viewed and can be printed but can't be altered containing the serial number and the use history of the unit queried.

User and weapon specific parameters, like total load count, establishing at what remainder number of rounds a luminous signal change will occur, a first load extra count in case the user prefer to carry a first shot chambered like most police officers do, a preview or demonstration mode to verify the count and the signal pattern or a reset to default, are all easily keyed in among others, by the user straight into the device via the program and reset switch without any supplementary equipment or accessory. Further implementations are also possible and quite simple to accommodate, like providing a point of access for an external detachable multiple control switch assembly containing a plurality of switches for enhanced preset and parameter selecting options. Another form of switching means considered as a convenient accessory is one adapted in a structure that slip temporarily over the weapon trigger, and adapted to mimic the discharge events signal, making it possible to train without live ammunition by allowing to virtually play back a load stack discharge for previewing the currently running signal pattern.

It is a primary object of this invention to provide to the user of a weapon with an assembly adapted to said weapon capable of reporting by means of visual indicators and a signaling method trailing feedback correlated to his ammunition load status, offering to said user the opportunity to become conditioned to react and act safely in view of a perceivable signal or perceivable signal change whilst using said weapon, in no different way that an automobile driver becomes conditioned to react to a luminous warning signal whilst driving in a city with luminous traffic signals in which a particular light color has an established, furthermore, a subconsciously engraved significance in aiding said driver to make safe decisions accordingly.

It is an object of this invention to provide a reliable method to detect, track and identify events happening in the operation of a weapon such that it serves as the supporting functional structure for an ammunition depletion warning system or a discharge monitoring and recording device, or the combination of both.

It is a further object of this invention to provide the advantages described in this application, on a low cost and extremely compact assembly that lends itself to be embedded or easily adapted to a weapon, or encased in a component structure in such manner that it can interchangeably replace an original component of said weapon, providing to the user with the benefits of this system in addition of it fulfilling at least the function of the component it replaced.

It is still a further object of this invention to provide a weapon discharging monitoring system that will enable time and date related usage to be recorded in a memory provision in correlation with the actual time and date data supplied by a real time clock, including means to download said records at a further date.

It is a further object of this invention to generate a dated and timed weapon discharge record, and furthermore, a secure digital document that will represent accurately the use history of a particular weapon.

BRIEF DESCRIPTION OF THE DRAWINGS

As a reference to aid in the understanding of the present invention the following drawings are provided in which.

DETAILED DESCRIPTION OF THE INVENTION

Figure 1:
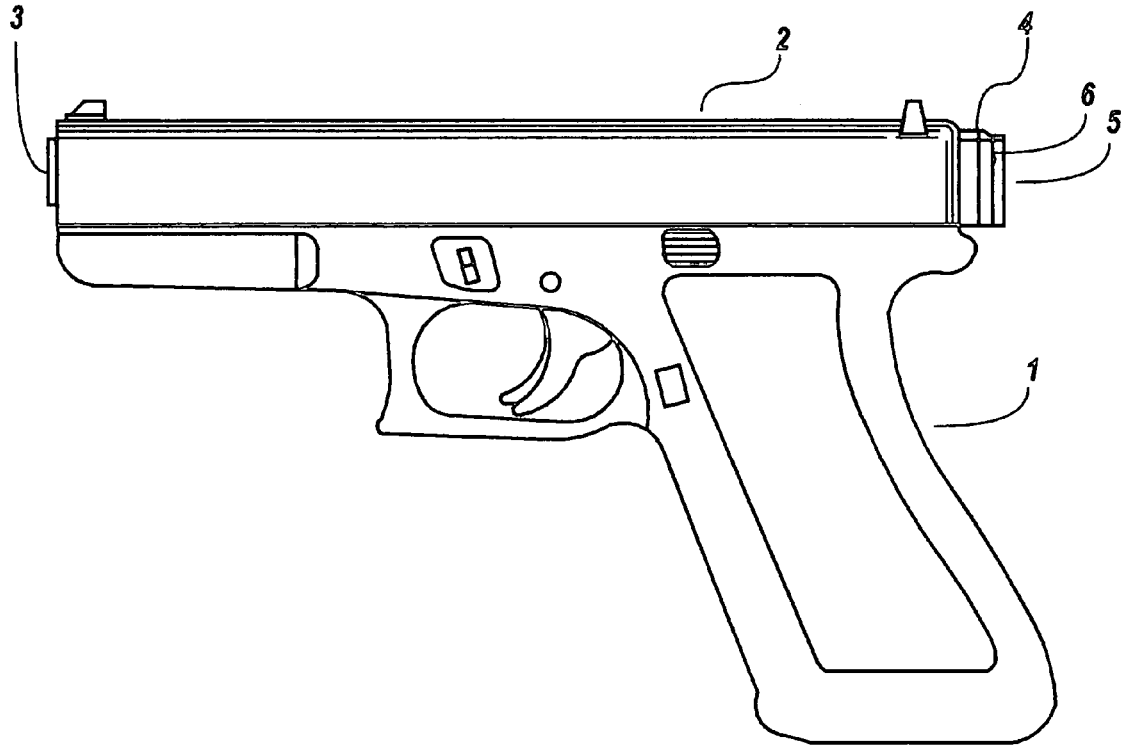
FIG. 1 is a simplified lateral view of a semiautomatic handgun in which the preferred embodiment is mounted.

Referring to the several views of the drawings; initially is viewed on: FIG. 1 is a simplified representation of the preferred embodiment of this invention installed in the rear of portion of the sliding carriage of a handgun, attached and held in place by an anchoring portion of its structure being nested and held in place by spring force in replacement of the firing pin cover plate.

On the weapon depicted, there is a frame 1, and a barrel 3 nested on a sliding structure 2 in the rear of which the monitoring assembly 4 is installed. The assembly has a recessed area 5 where the luminous indicators are located disposed to emit light in the direction of the user. There is a readily available program and reset button 6 that is adapted to reset the count to the count loop default at any point of use.

This control switch is used mostly for resetting to the default count the system every time needed but also serves to alter the presets on the embedded program. As a reference, by pressing and holding this control switch 6 for a first amount of time, a first level of programming becomes available to the user. When doing so, the device responds by reporting to the user by means of a special luminous pattern informing that certain parameter can be altered with the same switch like i.e. "adding to the total load count". By pulsing said control switch 5 consecutive times, 5 rounds have been added to the total count. When done with this process, by leaving it at rest for a duration and then pressing momentarily once more to return to default, another "press and hold" routine can be applied for a longer duration, the device then reports a different luminous pattern displayed and the controller opens another window of programmability which could be "subtract from the total load" and so forth. By utilizing this method and in combination with a second switch, a state change is invoked on the first switch, doubling the windows of opportunities for altering the presets.

Figure 2:
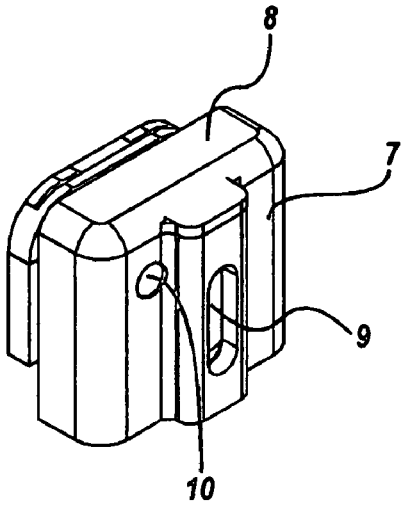
FIG. 2 is a rear three-dimensional view of the capsule containing the assembly.

FIG. 2 is the monitoring assembly in which a cover portion 8 is indicated, a metallic housing 7 covers and protects the electronic circuitry, a luminous indicators window 9 and a program and reset switch are shown.

Figure 2A:
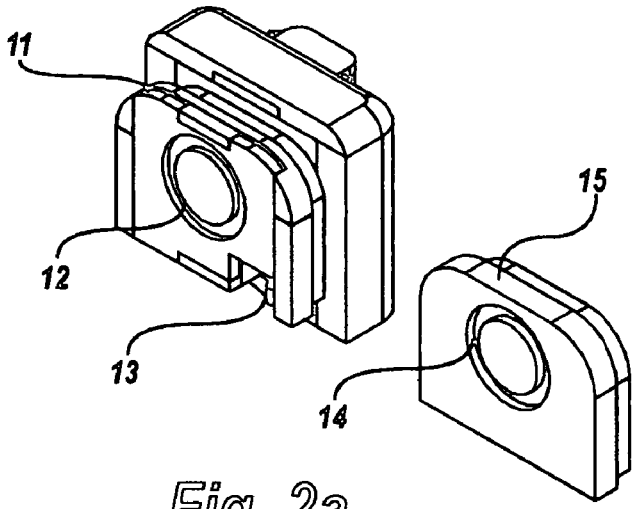
FIG. 2*a* is an angular rear view in which a firing ping cover plate and the system assembly are compared.

FIG. 2*a* depicts the monitoring assembly and the firing pin cover plate. Further demonstrates details 11 and 15 as being similar between the monitoring assembly and the firing pin cover plate as to provide similar engagement when installed in place.

Similarly, 12 and 14 indicates equivalent retention features as to nest the spring-loaded rear housing of the firing pin assembly when in place. Almost hidden but still visible in this view is the switching detector detecting arm 13.

Figure 3:
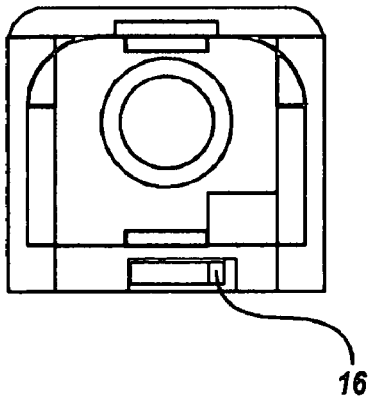
FIG. 3 is a rear view of the system's preferred assembly showing a switching slide position detector.

FIG. 3 is an orthogonal view of the back portion of the switching version of the monitoring assembly where 16 is the switch arm.

Figure 3A:
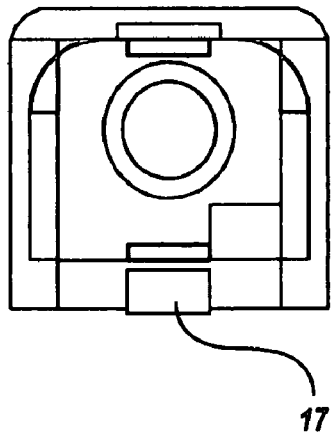
FIG. 3*a* is a rear view of the system's preferred assembly showing a piezoelectric film slide position detector.

FIG. 3*a* is an orthogonal view of the same device but the switching device has been replaced by a piezoelectric film component that is adapted to deflect on contact with the frame generating a pulse of electricity upon returning to the home position.

Figure 4:
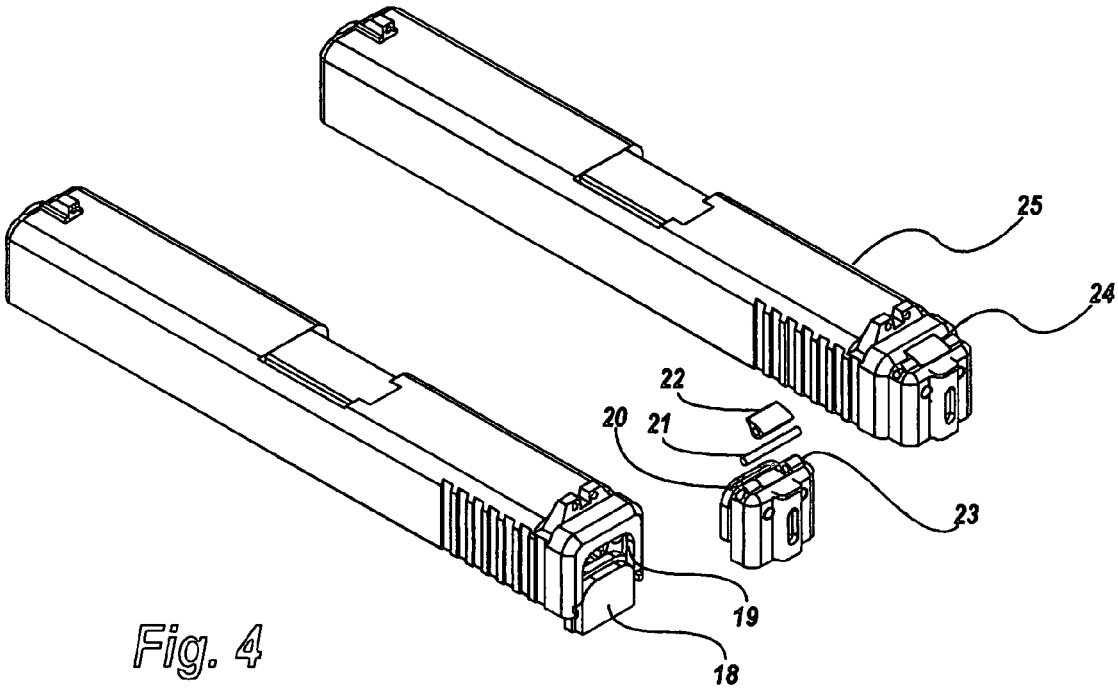
FIG. 4 is a depiction of the system's preferred assembly being installed in the firing pin cover plate well.

FIG. 4 shows the removal from a weapon slide of a standard firing pin plate cover 18 from its location 19 and replacing it with the monitoring assembly 20. This drawing also shows securing component 22 and metal pin 21. Further it shows the same weapon slide with the monitoring assembly already installed and secured with 22 in place and 21 installed in provision 24.

Figure 5:
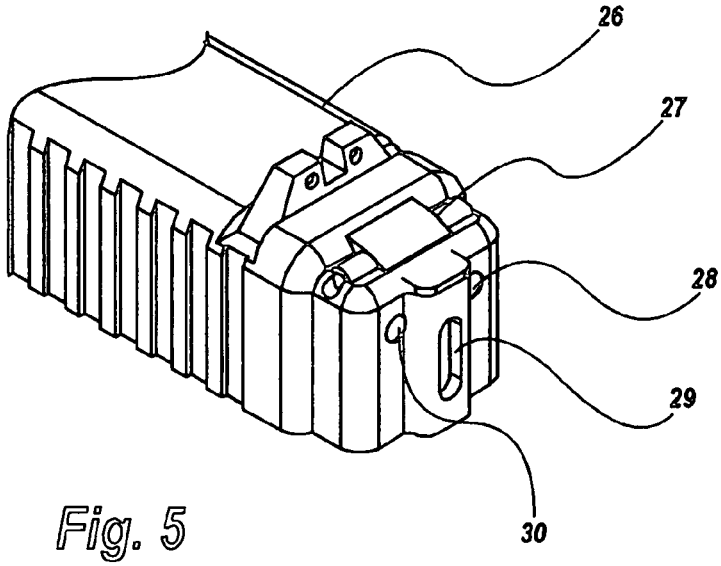
FIG. 5 is a cut close up view of the mounted assembly showing more detail.

FIG. 5 is a close-up view of the installation showing a version that includes a double control switch 30 and 28 for programming when the detecting means doesn't include a switching slide position detector that can perform as a control means. 6 is the weapon slide, 27 is the secure assembly and 29 shows the luminous indicator window.

Figure 6:
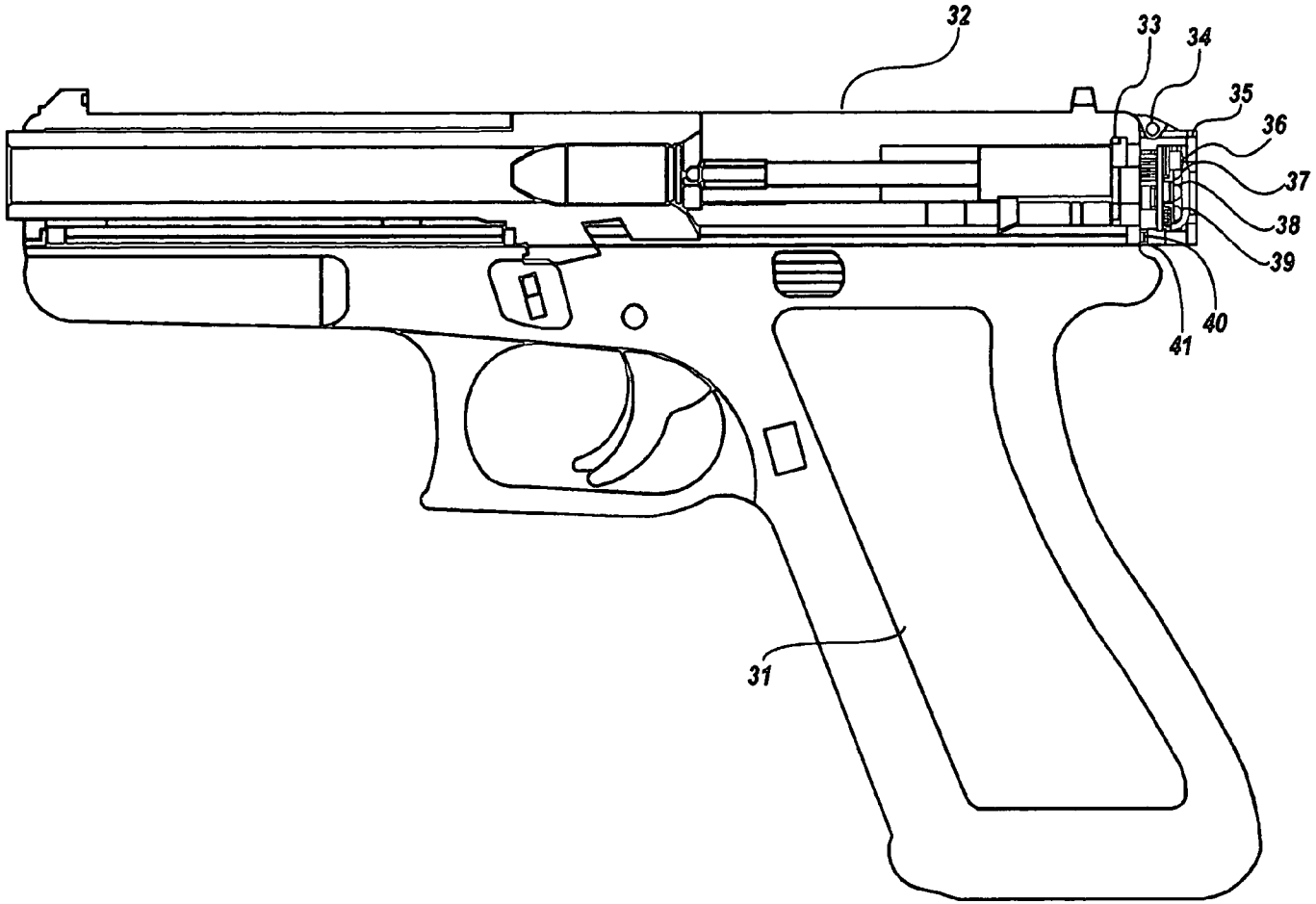
FIG. 6 is a simplified cut out view of a weapon with the system mounted showing more detail including the area of engagement of the slide position detector.

FIG. 6 is a simplified cross section of the weapon slide 32 and the monitoring and signaling device as attached in the firing pin cover plate well. 33 shows the engagement portion of the assembly as it resides nested in the slot provided for said cover plate, 34 shows the axial end of a retaining pin inserted to hold in place the securing component 22 in FIG. 4. 35 is the portion of the housing that encapsulates the electronic components. 36 is the program and reset switch, 37, 38 and 39 are the luminous indicators aimed on the direction of the user. The type used in this assembly are of a special highly efficient ultra bright family of dies packaged on a clear dome lens medium size surface mount device. The choice of these lamps is of crucial importance for obtaining a strong signal easily viewable at daylight and a long battery life.

40 is a cross sectional representation of what the home position of the slide position detector would be and 41 is the portion of the frame that bears in close contact against said detector detecting means.

Figure 7:
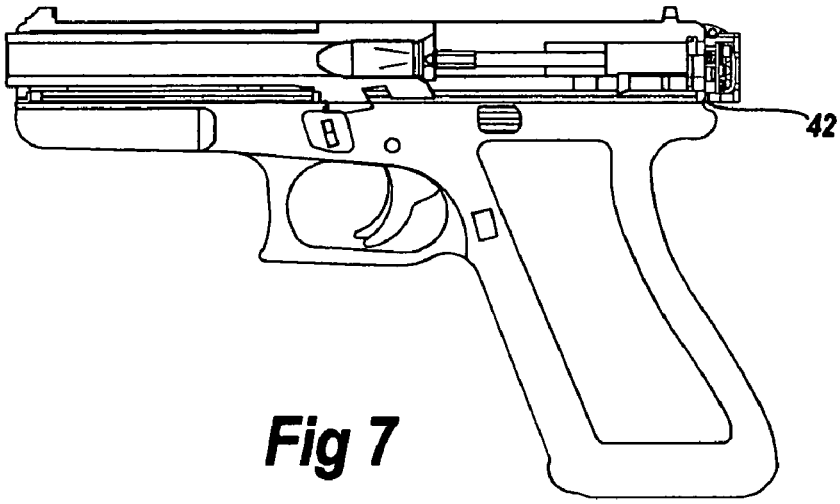
FIG. 7 is a simplified cut out view of a weapon containing this system at rest but in the instant the firing pin strikes a live round of ammunition.
Figure 8:
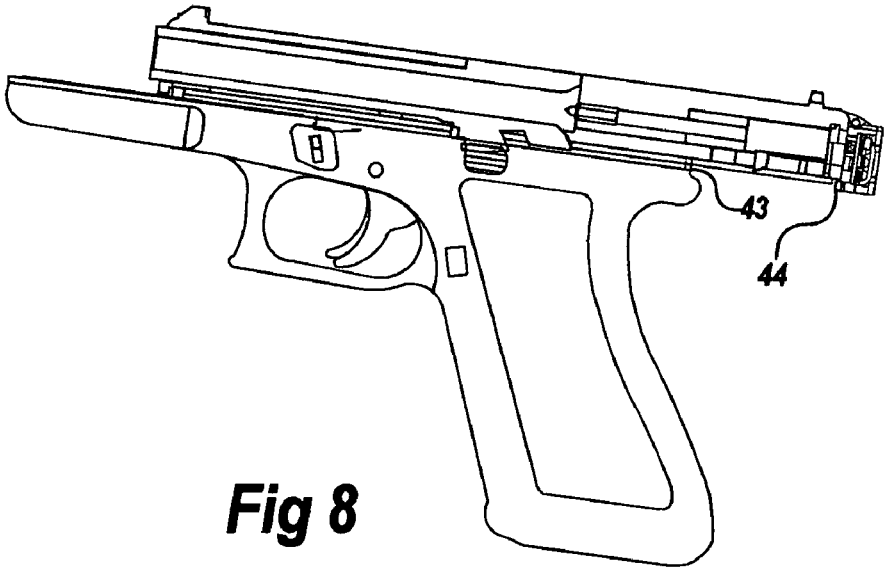
FIG. 8 is a simplified cut out view of the same weapon at the moment it has reached the limit of its rearward displacement as it tilts backwards as a consequence of the typical recoil.
Figure 9:
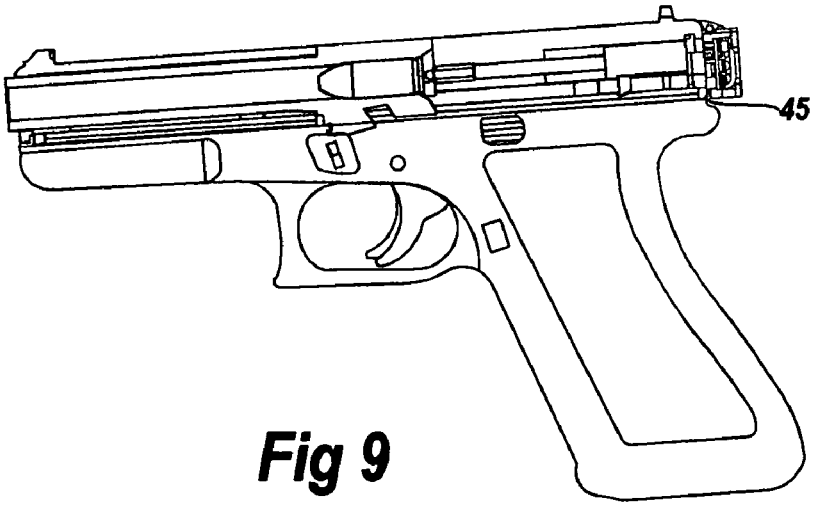
FIG. 9 is a simplified cut out view of the same weapon as it undergoes some amount of forward tilting typically induced by the slide returning to the home position with a new round as it slams into the limit stop

In FIGS. 7, 8 and 9 depict summarily the recoil activity as a result from discharging a round.

In FIG. 7 is the depiction of the weapon at rest in the instant it is going to be discharged where 42 is the point of contact between the monitoring device and the frame.

FIG. 8 represents the end of the rearward motion of the slide of the weapon including the rearward tilt typically induced by this event and the distance between 43 which is the mating part of the frame where the position detector makes contact at the rest position, and the detector 44.

FIG. 9 is the weapon at the point it has just slammed shut in its return to the home position with a new round in the chamber. The typical momentary forward tilt is also shown. 45 is the detector now back in contact with the frame.

Figure 10:
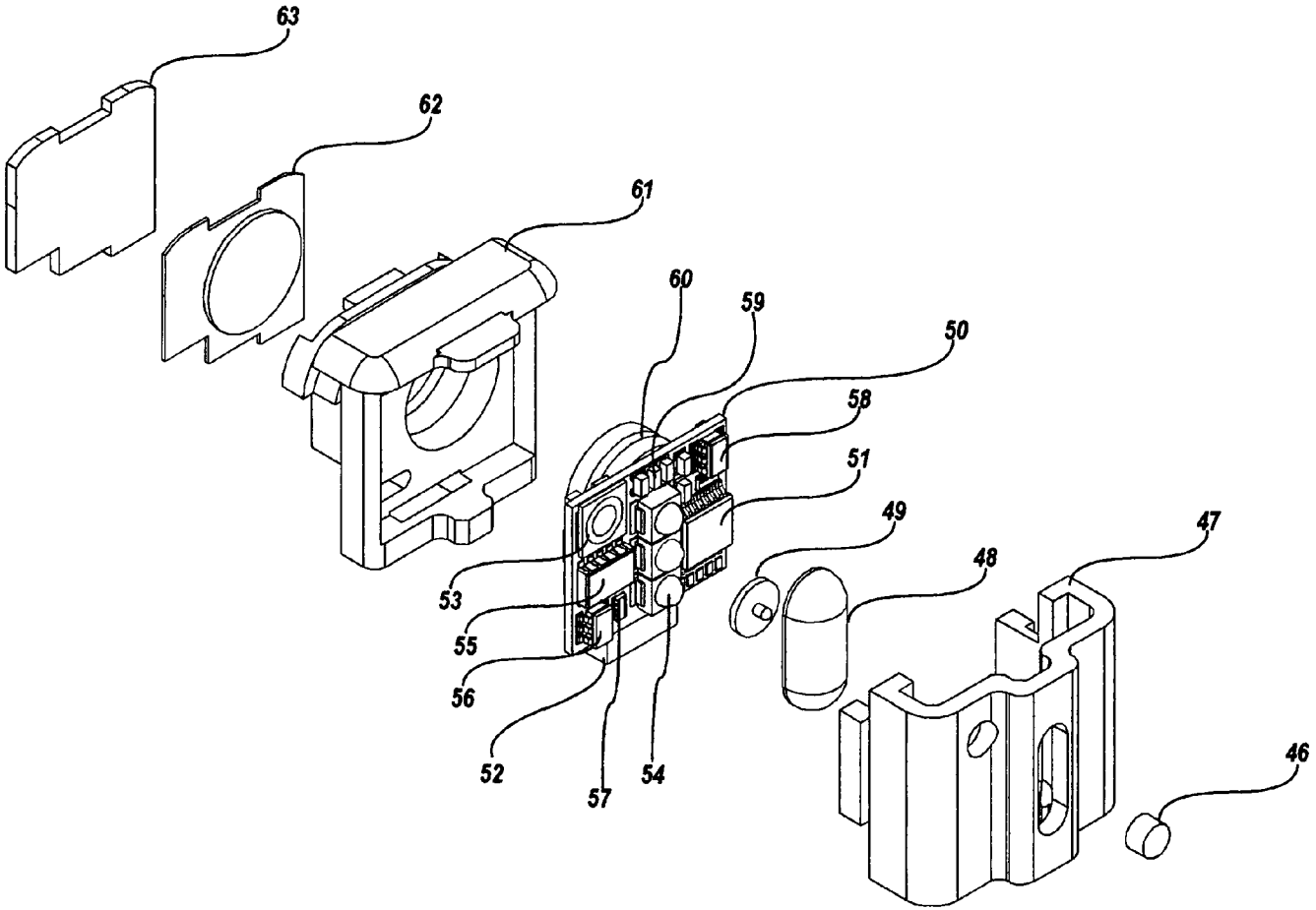
FIG. 10 is a frontal isometric exploded view of the monitoring device.

FIG. 10 is a frontal exploded view of the actual total assembly of the monitoring device where 47 is the metal housing which is manufactured from a section of a custom designed aluminum extrusion that has been cut to size and machined to further configure the features required and has also been heat treated for stiffness and furthermore anodized for corrosion resistance. There is a double side multilayer pc board 50 containing all the required surface mount components in a dense arrangement. To optimize the space distribution, an exact three dimensional model of each of the components required was constructed including the solder pads and following the layout restrictions, the space was optimally distributed. Due to the density of the resulting circuit, all signal routing is mostly done in buried layers accessing these from underneath the footprint of the components.

60 represent two lithium 1025 coin cells installed in series providing 6 volts of electricity to the circuit. 51 is the programmable controller that is the PIC16F630. This is a CMOS Flash-based 8-bit microcontroller in an extremely compact 14-pin TSSOP package. This device includes 1 comparator and 128 bytes of EEPROM data memory and 1024 words of program memory capacity, all of which in combination serve as a substantially sufficient platform for this application. 52 is the rear projection of the switching detector, 53 is an extremely low profile tactile switch to be actuated by plunger 49 and control switch 46 in combination. 54 is one of the surface mount ultra bright high efficiency LED luminous indicators and 48 is a cover lens intended to provide seal and protection and which may or may not provide a degree of diffusion in accordance to the visual report desired. 55 is a legless extremely compact clock device that contains a crystal integral to the same package resulting in a complete real time clock assembly for providing the real time base information to the controller so that the discharge events are correlated to real date and time. 56 is a $I^2C$ compliant eeprom device that receives and retains the information of the time and date the weapon being monitored was discharged. 57, 58 and 59 are representative of supporting components for the controller and the signal conditioning circuitry. 61 is a plastic injection molded structure that includes the details required to contain the assembly further fitting into the metal housing. 62 is a sealing gasket component aimed also to provide electrical isolation to the assembly and 63 is a structural metallic component that will act as a lid and as a mating member when in place and in contact with the weapon's firing pin.

Figure 11:
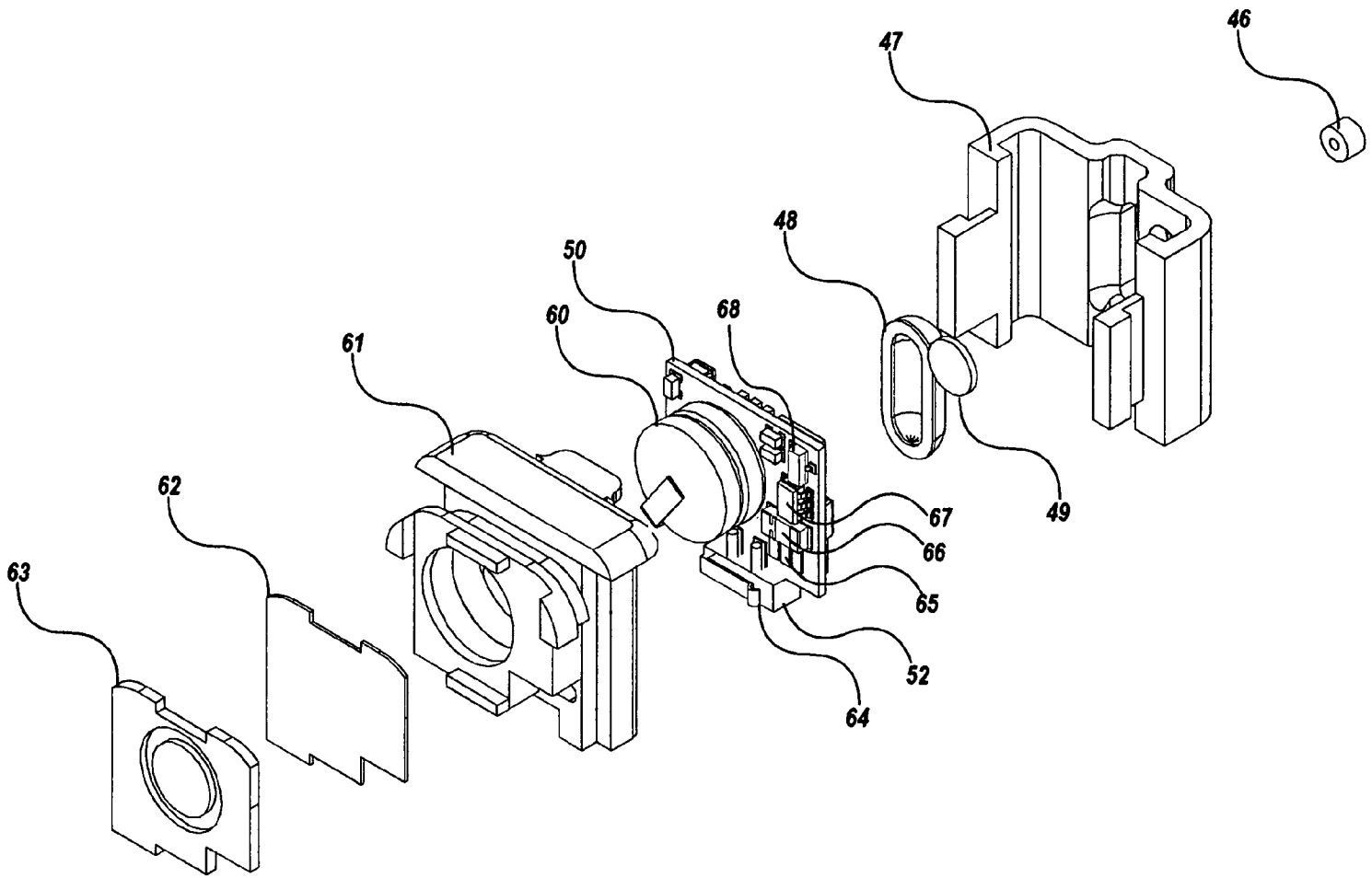
FIG. 11 is a rear isometric view of the same.

FIG. 11 is a rear view of the exploded assembly in which 64 is the switch arm of switching detector 52, 65 are three pads in place for accessing the memory provision.

66 is a surface mount piezoelectric device which is represented here as one possibility of detecting dynamics utilized in this preferred embodiment but this could be replaced by a cantilevered bimorphic ceramic component or a piezoelectric film inertial flapper or a rotational sensor and the corresponding supporting electronics represented among 67, 68, 57, 58, 59 and others depicted and not numbered would be adequately replaced.

Figure 12:
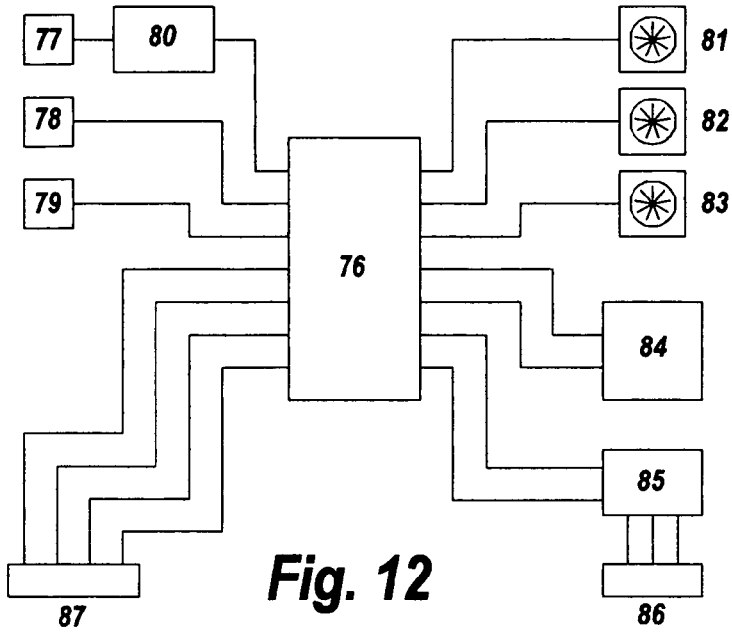
FIG. 12 is a diagram representing in succinct mode the concept of how the functional components fit in the system circuit.

In FIG. 12 is not a circuit schematic but a basically objective diagram. In here, 76 is the controller to which the indicator lamps 81,82 and 83 are attached. 79 is the control means which is actually the program and reset switch. 78 is the switching detector, which is also a control means for invoking a second level of programming use in 79. In the case of the version of the system that utilizes a single piezoelectric detector, 78 is installed as 79 in immediate access to the user and becomes a device of control only. 77 is the main dynamics detector and 80 is the signal conditioning circuitry interfaced between the output yielded by 77 and the controller 76. 84 is the real time clock device, which includes a crystal, and 85 is the $I^2C$ compliant eeprom device. 86 is the point of access for retrieving the data stored in 85.

Figure 13:
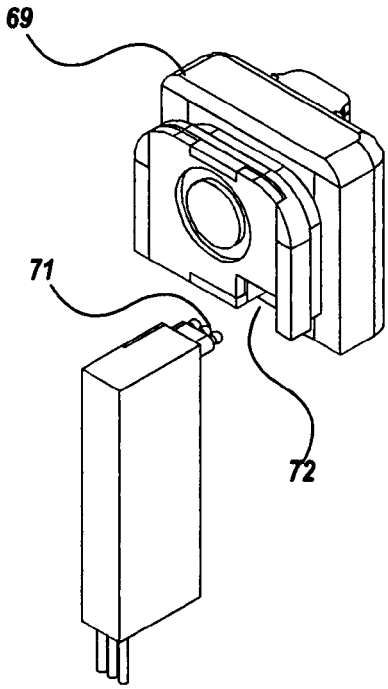
FIG. 13 includes is an explanatory view of the procedure of connecting into the monitoring device for downloading data.

FIG. 13 is a view that shows the monitoring device 69 indicating the location of access port for data download 72. The download plug 70 shows tip 71 aimed to contact the download pads 73 of assembly 74. 75 depict the plug output to the download interface. For clearer viewing, this is shown as displayed, but this operation can be performed as the unit is mounted onto a weapon.

Figure 14:
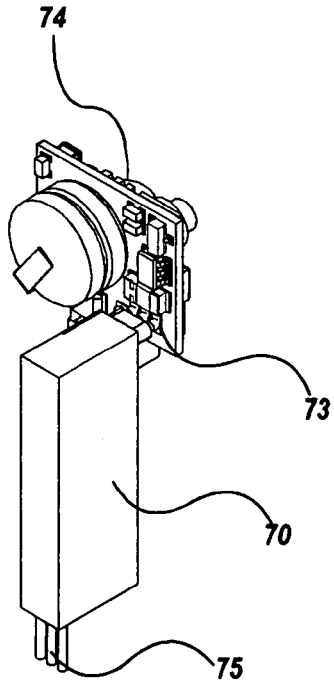
FIG. 14 is a diagram representing in succinct mode on the concept of how the functional components fit in the circuit of the data download interface.
Figure 14:
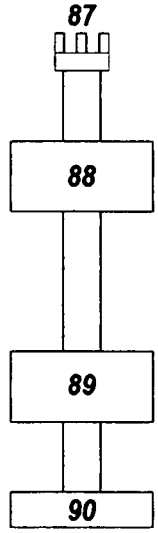

FIG. 14 is a diagrammatic representation of a typical interface that can be used to access the data stored on the eeprom utilizing its provided $I^2C$ serial interface capability. 87 relates to the download plug as also seen on FIG. 13, numbers 70, 71 and 75. 88 is the microcontroller PIC16F630 in charge of carrying on the querying, the handshake and security protocols of the monitoring system, and 89 is a MAX232 driver/receiver that is a low power interface translator for further communicating with a personal computer via a DB9M serial connection. The computer attached will be running special encryption software for the purpose of downloading the contents of the memory storage and the serial number of the device in a way that its output is a read-only file in order to prevent tampering with the reported data.

Figure 15:
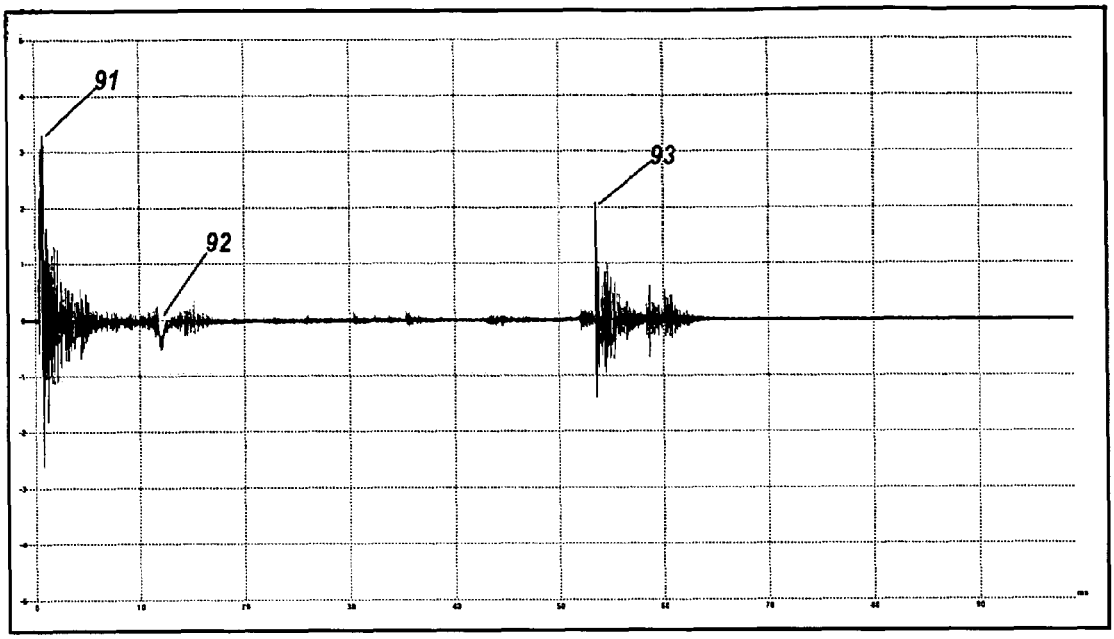
FIG. 15 is a printout of data acquired from the dynamically induced set of pulses on a properly adapted piezoelectric detecting device during the complete cycle of discharge and reload of a composite frame pistol.

FIG. 15 is a pulse set acquired from a firing and reload sequence from a composite frame recoil operated handgun in which 91 is the electrical portion resulting from the actual discharging of the round, 92 is the moment of inversion of the slide motion at the end of the recoil, and 93 is the collision of the slide against the forward limit stop of the return stroke.

Figure 16:
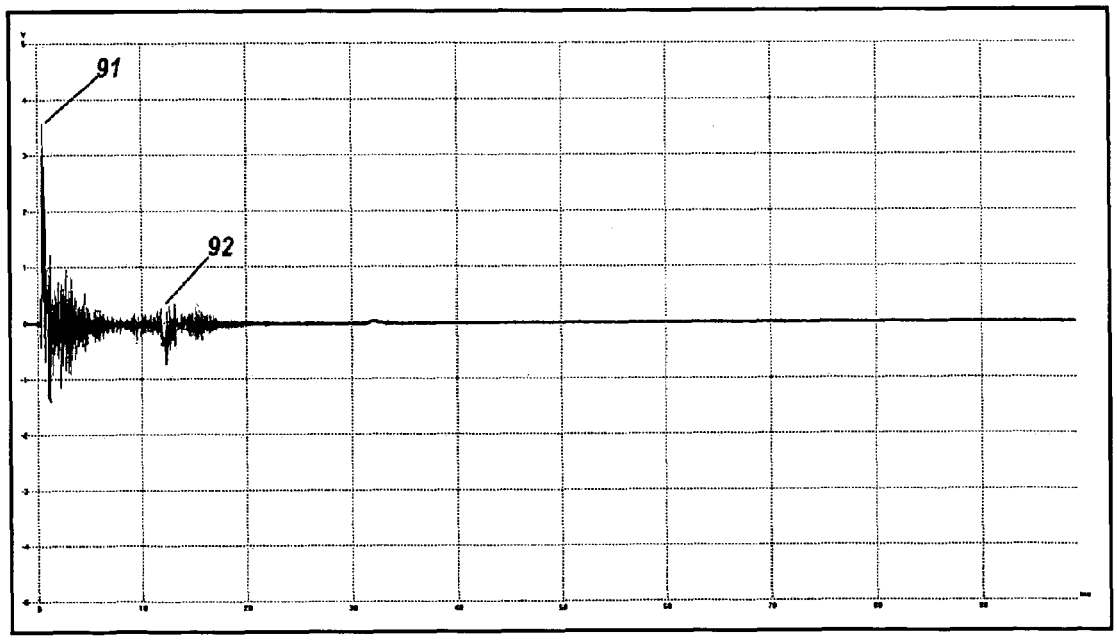
FIG. 16 is a printout of data acquired from the same set up as above but is recorded from a discharge only with no reload.

FIG. 16 is a pulse set acquired from firing a single and last round from a load in the same weapon in which segments 91 and 92 are present and 93 is not within the corresponding time grid.

Figure 17:
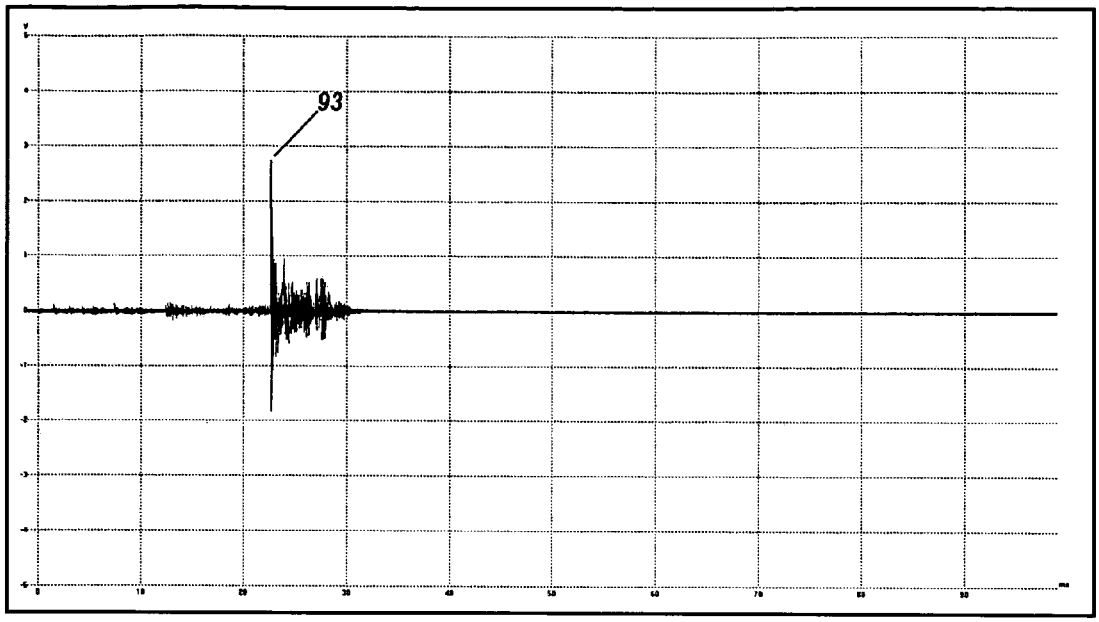
FIG. 17 is a printout of data acquired from the same set up as above but recorded from reloading a round from a clip by releasing the slide from a hold open position, where the detent is released allowing the spring to propel the slide to return to home.

FIG. 17 is a pulse set acquired from releasing the slide from a hold open position where the slide spring is preloaded and said slide returns to home propelled by said spring as it drags and chambers a new round from a clip. Segment 93 is generated by the abrupt deceleration and collision of the slide against the home stop.

Figure 18:
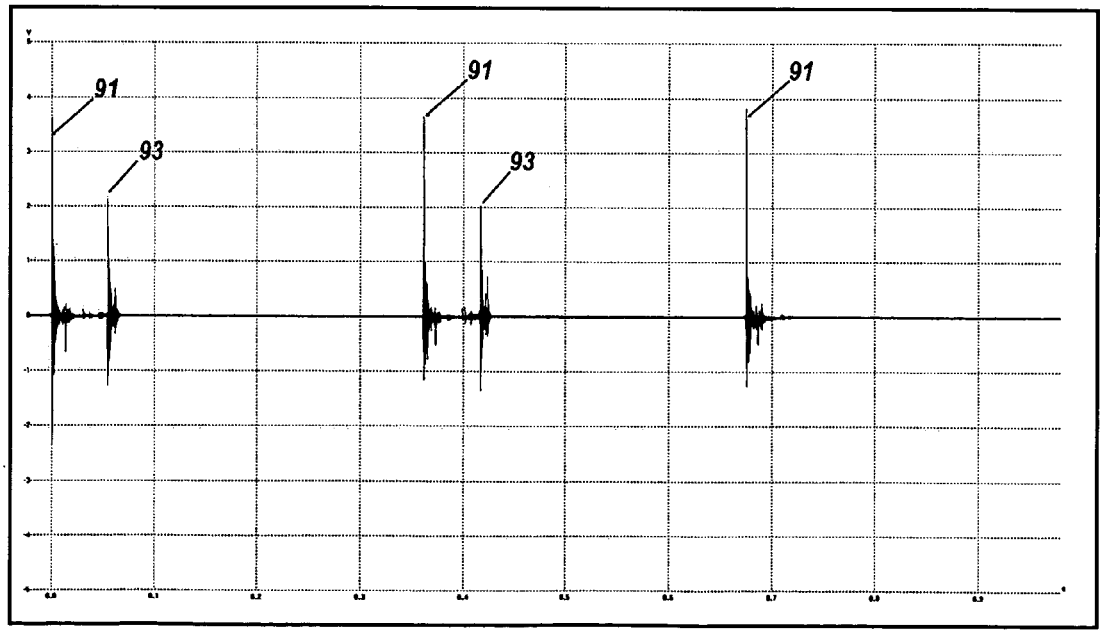
FIG. 18 is a printout of data acquired also from the same set up as above but recorded from discharging the last three rounds from a load in relative close succession, where the clip was emptied and the slide was left open in a captive position.

FIG. 18 are a pulse sets generated by discharging on the same type of weapon, three rounds within a time frame <0.7 seconds, where these rounds where the three last of a load. 91 and 93 are present in the first two pulse sets, but absent on the last one.

What is claimed is:

1. On a weapon having a structure including components that engage in dynamic activity upon said weapon being operated and being of the type adapted to carry a load of ammunition, and following an automatic activity cycle of a duration typical to said weapon, discharge a round, and successively reload a next round of ammunition from said load or remain in a hold open position when the discharged round was the last one from said load, a microprocessor based assembly, including a power source and provisions to store and run programs, and being enabled at least, to track weapon activity occurring within the typical duration of said weapon automatic cycles of operation, in combination with a piezoelectric detector, adequately adapted to said weapon as to generate electrical impulse sequences induced on said detector by dynamic events including structural shock, vibration, and abrupt changes in acceleration, substantially resulting from discharging a round and from chambering another, in which provisions are made such that, upon said piezoelectric detector detecting activity on said weapon, said microprocessor executes activities conducive to determine at least if said weapon was only discharged, or if it discharged and successively reloaded, by ascertaining if within the lapse of time substantially corresponding to the typical duration of an automatic cycle of operation on said weapon, and within the sequence of detected electrical impulses thusly generated, impulses reporting only a discharge, or impulses reporting a discharge, followed timely by others reporting the reloading of a new round were present, and in which, further provisions are made such that, said microprocessor based assembly executes thereon activities for tracking count of the discharge of ammunition on said weapon, including further provisions for tracking load discharge counts and for resetting a load discharge count to default for restarting tracking a new load count upon identifying the discharge of a round with no following reload.

2. The assembly of claim 1 in which said assembly is adapted to be responsive and to become enabled from a lower power wait state upon said weapon being operated, having further provisions to enable the automatic return of said assembly to said lower power wait state.

3. The assembly of claim 1 comprising control means provisions.

4. The assembly of claim 3, in which further provisions are made, as to allow modifying, selectively enabling, activating, recalling and altering presets, and still further resetting said assembly by utilizing a control means.

5. The assembly of claim 1 in combination with a switching device adapted to function as a movable weapon component status detector and a control means.

6. The assembly of claim 1 including more than one piezoelectric detector working cooperatively in an electrically unified structure as to generate an electrically higher combined event report.

7. The assembly of claim 1 in which a weapon operation event detecting means capable of detecting dynamic events occurring on said weapon characterized by abrupt inclination is used.

8. The assembly of claim 1 in combination with signal means provisions, including further provisions for activating said signal means.

9. The assembly of claim 8, in which said signal means is conformed by a visual display that displays a report following a pattern preset that is adapted to be indicative of the status of said load of ammunition, being said visual signal means disposed on said weapon in such manner that it provides to the user with a substantially visible reports related at least, to the status of said load of ammunition.

10. The assembly of claim 9, in which said signal means is built into a functional component of said weapon in such manner that it provides to the user with a substantially visible report in relation to the status of said load of ammunition while also performing as the component it replaced.

11. The assembly of claim 9 in which said visual report indicating pattern preset is customizable.

12. The assembly of claim 1 in which said assembly has non volatile data storage provisions.

13. The assembly of claim 1 in which said assembly has provisions for establishing and recording on said data storage provisions, a historical usage record including at least date and time information regarding said weapon discharge events.

14. The assembly of claim 12, in which provisions are made for embedding and retrieving of user traceable information.

15. The assembly of claim 12 in which said assembly has access provisions to retrieve previously recorded data.

16. The assembly of claim 12 in which said data storage provisions include security limiting means for accessing said stored data.

17. The assembly of claim 1, including removably adapted data access and control provisions.

18. The assembly of claim 1 including provisions to electrically modify said electrical impulse sequences generated by said piezoelectric detector.

19. The assembly of claim 18 having provisions enabling that said electrically modified electrical impulse sequences be subjected to cyclic routines intended to substantially eliminate the lower level electrical impulse portions contained within electrical impulse sequences generated by said piezoelectric detector.

20. The assembly of claim 1 in which said detector is adapted with vibration dampening provisions.

21. The assembly of claim 1 including tracking error management provisions of potentially detected spurious or anachronic events.

22. The assembly of claim 1 including provisions for storing and utilizing electrical impulse threshold level identification means presets.

23. The assembly of claim 1 including provisions for storing and utilizing weapon cycle and dynamic event timing presets.

24. The assembly of claim 1 including provisions for storing and utilizing electrical impulse duration presets.

25. The assembly of claim 1 including provisions for storing and utilizing presets for applying cyclic gating of lower level portions of the electrical impulses detected within an electrical pulse sequence generated by an activity cycle of said weapon.

26. The assembly of claim 1 including provisions for storing and utilizing presets for applying a level of synchronized cyclic neutralization to the lower level portions of the electrical impulses detected within an electrical pulse sequence generated by an activity cycle of said weapon,

27. The assembly of claim 1 including provisions for storing, recalling and selectively enabling at least one preset related to at least one microprocessor electrical impulse identification related activity.

28. The assembly of claim 1 including provisions to store and recall presets typical to more than one weapon.

29. The assembly of claim 8 including further provisions for storing and selectively enable digitally managed energizing pattern presets for energizing said signal display.

30. The assembly of claim 9 in which said visual display is luminous in nature.

31. The assembly of claim 30 in which said visual display comprises at least one LED device.

32. The assembly of claim 31 utilizing multicolored LEDs enabled to display a plurality of colors.

33. The assembly of claim 31 in which said visual display comprises a plurality of multicolor LED devices providing visual feedback to the user by becoming and remaining illuminated in an apparent steady state, whilst being energized utilizing a power saving illuminating pattern.

34. The assembly of claim 1 including a power source switching means.

35. The device of claim 1 in which provisions are made for identifying said weapon is operating in automatic mode, by establishing that the frequency of the higher level electrical impulses detected, closely corresponds to said weapon automatic rate of fire.

36. The assembly of claim 1 in which provisions are made to automatically reset a tracked count to default when chambering a new round manually.

37. On a weapon, having a structure including components that engage in dynamic activity upon said weapon being operated, and being of the type adapted to carry a load of ammunition, and following an automatic activity cycle of a duration typical to said weapon, discharge a round and successively reload a next round of ammunition from said load or remain in a hold open position when the discharged round was the last one from said load, a microprocessor based assembly, including a power source and provisions to store and run programs, being enabled at least, to track weapon activity occurring within the typical duration of said weapon automatic cycles of operation, in combination with piezoelectric detecting means, adequately adapted to said weapon as to generate electrical impulse sequences, induced on said detector, by dynamic events including structural shock, vibration, and abrupt changes in acceleration, substantially resulting from discharging a round and from chambering another, in which provisions are made such that, upon said piezoelectric detecting means detects activity on said weapon, said microprocessor executes activities conducive to determine at least if said weapon was only discharged, or if it discharged and successively reloaded, by ascertaining if within the lapse of time substantially corresponding to the typical duration of an automatic cycle of operation on said weapon, and within the sequence of detected electrical impulses thusly generated, impulses reporting only a discharge, or impulses reporting a discharge, followed timely by others reporting the reloading of a new round were present, and in which, further provisions are made such that, said microprocessor based assembly executes thereon activities for tracking count of the discharge of ammunition on said weapon, including further provisions for tracking load discharge counts and for resetting a load discharge count to default for restarting tracking a new load count upon identifying the discharge of a round with no following reload.

38. On a weapon, having a structure including components that engage in dynamic activity upon said weapon being operated, and being of the type adapted to carry a load of ammunition, and following an automatic activity cycle of a duration typical to said weapon, discharge a round and successively reload a next round of ammunition from said load or remain in a hold open position when the discharged round was the last one from said load, a microprocessor based assembly including a power source and provisions to store and run programs, and being enabled at least, to track weapon activity occurring within the typical duration of said weapon automatic cycles of operation, in combination with detecting means, adequately adapted to said weapon as to send electrical impulses to said microprocessor based assembly in substantial synchronicity with said weapon discharging a round and when chambering another, and in which, further provisions are made such that, upon said detecting means sends electrical impulses to said microprocessor based assembly, said microprocessor thereon tracks said electrical impulses and executes further activities conducive to determine at least if said weapon was only discharged, or if it discharged and successively reloaded, by ascertaining if within the lapse of time substantially corresponding to the typical duration of an automatic cycle of operation on said weapon, and within the sequence of the received electrical impulses, impulses reporting only a discharge, or impulses reporting a discharge followed timely by others reporting the reloading of a new round were present, and in which, further provisions are made such that, said microprocessor based assembly executes thereon activities for tracking count of the discharge of ammunition on said weapon, including further provisions for tracking load discharge counts and for resetting a load discharge count to default for restarting tracking a new load count upon identifying the discharge of a round with no following reload.

* * * * *

UNITED STATES PATENT AND TRADEMARK OFFICE

CERTIFICATE OF CORRECTION

PATENT NO. : 7,509,766 B2
APPLICATION NO. : 10/773862
DATED : March 31, 2009
INVENTOR(S) : Vasquez It is certified that error appears in the above-identified patent and that said Letters Patent is hereby corrected as shown below:

THE TITLE PAGE I PLEASE DELETE ITEM (76) AND INSERT ITEM (76)
Eduardo Carlos Vasquez, P.O. Box 145187, Coral Gables, FL (US) 33134-5187

Column 7, line 2 "enemy" should read "energy"

Column 9, line 55 "invention's" should read "inventor's"

Column 10, line 42 delete "would"

Signed and Sealed this

Fifth Day of May, 2009

JOHN DOLL
*Acting Director of the United States Patent and Trademark Office*